US006704962B2

(12) United States Patent
Choi

(10) Patent No.: US 6,704,962 B2
(45) Date of Patent: Mar. 16, 2004

(54) ELASTIC BODY, METHOD FOR MANUFACTURING THE SAME AND MATTRESS INCLUDING THE SAME

(76) Inventor: Youn Soo Choi, 301-401, Gangseonmaeul, 43, Juyeop-Dong, Ilsan-Gu, Goyang-Si, Gyeonggi-Do 411-370 (KR)

( * ) Notice: Subject to any disclaimer, the term of this patent is extended or adjusted under 35 U.S.C. 154(b) by 96 days.

(21) Appl. No.: 10/019,926

(22) PCT Filed: May 9, 2001

(86) PCT No.: PCT/KR01/00755

§ 371 (c)(1),
(2), (4) Date: Jan. 2, 2002

(87) PCT Pub. No.: WO01/85598

PCT Pub. Date: Nov. 15, 2001

(65) Prior Publication Data

US 2003/0101517 A1 Jun. 5, 2003

(30) Foreign Application Priority Data

May 12, 2000 (KR) ..... 2000-25425

(51) Int. Cl.[7] ..... A47C 27/14
(52) U.S. Cl. ..... 5/740; 5/655.9; 5/953
(58) Field of Search ..... 5/740, 655.9, 953, 5/641

(56) References Cited

U.S. PATENT DOCUMENTS

| | | | | | |
|---|---|---|---|---|---|
| 1,887,310 | A | * | 11/1932 | King et al. | 267/145 |
| 1,980,445 | A | * | 11/1934 | Sherover | 5/740 X |
| 1,994,234 | A | * | 3/1935 | Sherover | 5/740 X |
| 2,617,751 | A | * | 11/1952 | Bickett | 428/166 |
| 2,768,924 | A | * | 10/1956 | Wright | 428/72 |
| 2,835,313 | A | * | 5/1958 | Dodge | 5/740 |
| 3,503,840 | A | * | 3/1970 | Parrish | 5/953 X |
| 4,194,255 | A | * | 3/1980 | Poppe | 5/740 X |
| 4,809,374 | A | * | 3/1989 | Saviez | 5/420 |
| 5,353,455 | A | * | 10/1994 | Loving et al. | 5/740 X |
| 5,452,488 | A | * | 9/1995 | Reinhardt | 5/729 |
| 2003/0101517 | A1 | * | 6/2003 | Choi | 5/740 |

FOREIGN PATENT DOCUMENTS

| | | | | |
|---|---|---|---|---|
| GB | 389833 | A * | 3/1933 | 5/740 |
| JP | 61-122885 | | 6/1986 | |
| KR | 1995-26532 | | 10/1995 | |
| KR | 1998-10603 | | 5/1998 | |

* cited by examiner

*Primary Examiner*—Robert G. Santos
(74) *Attorney, Agent, or Firm*—Merchant & Gould P.C.

(57) ABSTRACT

Disclosed are an elastic body having a good elasticity and an impact absorbing efficiency, a method of manufacturing the same and a mattress employing the same. The elastic body is a foamed polyurethane body including polystyrene and has a plurality of foams in which air is contained. The elastic body is prepared by a method comprising the steps of preparing polyether polyol by mixing poly alcohol and a polyether compound in a mixing ratio of 3–5 to 5–7 by weight, obtaining a polyol mixture by adding 2–20 parts by weight of polystyrene and a trace amount of a catalyst and water to 30–50 parts by weight of the obtained polyether polyol, adding and stirring 20–60 parts by weight of an isocyanate compound to 40–80 parts by weight of the polyol mixture at 20–80° C., and pouring the resulting product into a mold to foam cast. A mattress manufactured by using such elastic bodies has a good elasticity and is capable of absorbing pressure, thereby providing comfort for users.

12 Claims, 3 Drawing Sheets

ELASTIC BODY, METHOD FOR MANUFACTURING THE SAME AND MATTRESS INCLUDING THE SAME

TECHNICAL FIELD

The present invention relates to an elastic body, a method for manufacturing the same, and a mattress including the same, and more particularly to an elastic body having suitable elasticity and capable of retaining various additives for a long period of time, an advantageous method for manufacturing the same and a mattress including the same, thereby providing suitable elasticity and comfort for users.

BACKGROUND ART

Generally, iron coil springs, highly dense sponge blocks made from polyurethane or latex, or rubber balls have been used as elastic supporting means for bed mattresses.

The iron coil springs have been the most widely used elastic supporting means for the bed mattresses because they can provide superior elasticity for a long period of time. There are, however, some drawbacks to the iron coil springs for users. Since a plurality of springs are used by being connected to one another, pressure or impact applied to a particular area of a mattress causes the entire mattress to shake, thereby providing an unstable feel to the users. In addition, metallic noise disturbs the users, and sometimes the springs pierce the upper portion of the mattress to the extent that a mattress cover or sheet is damaged.

Bed mattresses using the highly dense sponge blocks made from polyurethane or latex do not generate such metallic noise, but allow the users to have comfortable sleep with a soft feel. However, the elasticity of the sponge blocks not only reduces as time passes, but also becomes uneven as a rebound property of the sponge blocks at the most used portions of a mattress such as edges is relatively lowered.

The rubber balls having a single inner space or air balls having a plurality of separated inner spaces are elastic supporting means that can provide a comfortable feel different from the feel of the above-mentioned springs or sponge blocks. The elasticity of such balls decreases whenever air is leaked out of the balls as time passes, and it becomes uneven due to climate influence. To fill the air-leaked balls with air or to exchange them to new balls is not only a hassle but also an expense. Moreover, a peculiar rubber smell from aging ruins a comfortable indoor environment.

In order to solve the aforementioned problems found in each elastic supporting means, the present inventor disclosed an elastic and independent body as Korean utility model number 0135979, filed on Aug. 9, 1996 and issued on Nov. 9, 1998. The elastic and independent body is an air permeable sponge having a net-shaped structure with air holes and sponge membranes made from polyurethane- and rubber-based compounds.

In comparison with prior elastic supporting means, the elastic and independent body provides superior comfort for its users on the grounds that its elasticity is uniformly maintained regardless of the lapse of time or changes in weather conditions, that it is free from a smell from aging, and that it provides suitable elasticity and softness. In the said Korean utility model, a mattress is manufactured in such a way that a plurality of independently formed elastic bodies are arranged to form a mattress shape and are supported and wrapped. This mattress is designed to minimize a transmission of fluctuation caused by a person lying on a certain mattress surface to an extent that the next person lying on the mattress is not affected.

FIG. 1A is a perspective view of an air permeable sponge elastic body and FIG. 1B is a cross-sectional view showing the inner structure of the air permeable sponge elastic body.

Referring to FIG. 1A, an air permeable sponge elastic body 10 has a substantially cylindrical shape, and its center portion has a concave portion 14 to which two convex portions 12, 13 are adjacent. Each of the two convex portions 12, 13 in a spherical shape is truncated in an upper portion 16 and in a lower portion 17, respectively. The elastic body 10 has superior elasticity arising from its material and structural properties. The elastic body 10 having the concave portion 14 at the center thereof as shown in FIG. 1A can provide its users with comfort in harmony with elasticity and resilience.

Since this elastic body has an elasticity stemmed from a foamed membrane, an absorption force of an external impact is weak whereas a repulsive force thereof is strong. Each foam, making contact with its adjacent foams, in the net-shaped sponge structure is air permeable. Due to the air permeability, there is a problem that additives such as anti-bacteria agents and perfumes are easily volatilized into the air via passages, so that-effects provided by the additives are reduced by the use for a long period of time.

Referring to FIG. 1B, the inner structure of the elastic body 10 is shown with an enlarged cross-sectional view. The inner structure has a plurality of foams 16 which are air permeable, so that air can pass among and through the adjacent foams. It should be noted that although each foam is merely illustrated in a spherical shape for convenience, the foam could be formed in various shapes in practice to have a predetermined space.

DISCLOSURE OF INVENTION

Therefore, taking account of the above problems, it is a first object of the present invention to provide an elastic body capable of maintaining a proper elasticity for a long-term use and retaining additives such as anti-bacterial agents and perfumes for a long period of time.

It is a second object of the present invention to provide an advantageous method of manufacturing the elastic body.

It is a third object of the present invention to provide a mattress which is manufactured by using the elastic body, so that it has a good elasticity and an improved impact absorption force.

To achieve the first object, there is provided an elastic body which is made from a foamed polyurethane polymer including polystyrene and has a plurality of foams in which air is contained and at least one concave portion at the center thereof. The elastic body is prepared by a method comprising the steps of mixing a polyol compound and a polyether compound in a mixing ratio of 3–5 to 5–7 by weight, adding 2–20 parts by weight of polystyrene and a trace amount of a catalyst to 30–50 parts by weight of the obtained mixture, adding and stirring 20–60 parts by weight of an isocyanate compound and water at 20–80° C., and molding the obtained reactant.

The second object of the present invention is accomplished by a method comprising the steps of obtaining polyether polyol by mixing poly alcohol and a polyether compound in a mixing ratio of 3–5 to 5–7 by weight, producing a polyol mixture by adding 2–20 parts by weight of polystyrene, a trace amount of a catalyst and water to 30–50 parts by weight of the obtained polyether polyol, and mixing 40–80 parts by weight of the obtained polyol mixture and 20–60 parts by weight of an isocyanate compound at 20–80° C. and foam molding the obtained reactant.

The third object of the present invention is accomplished by a mattress comprising an elastic body array obtained by arranging side by side the above mentioned elastic bodies within a predetermined area, a supporter which is assembled to support said elastic bodies at concave portions of said elastic bodies, two flat plates provided at upper and lower portions of said elastic body array, and a wrapping means for wrapping said elastic body array, said supporter and said flat plates.

BEST MODE FOR CARRYING OUT THE INVENTION

The above objects and other characteristics and advantages of the present invention will become more apparent with reference to the following detailed description and the accompanying drawings in which the characteristics of the various embodiments according to the present invention are exemplified.

Hereinafter, a preferred embodiment of the present invention will be explained in detail with reference to the accompanying drawings.

Figure 1A:
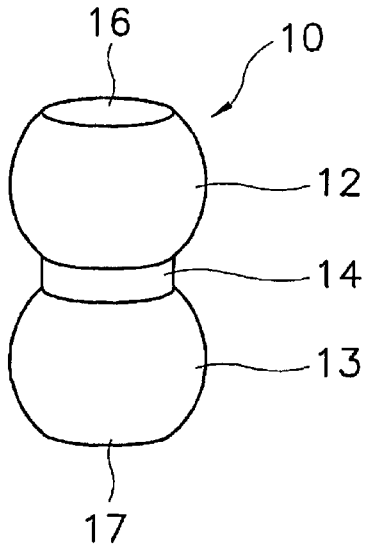
FIG. 1A is a perspective view of a prior elastic independent body.
Figure 1B:
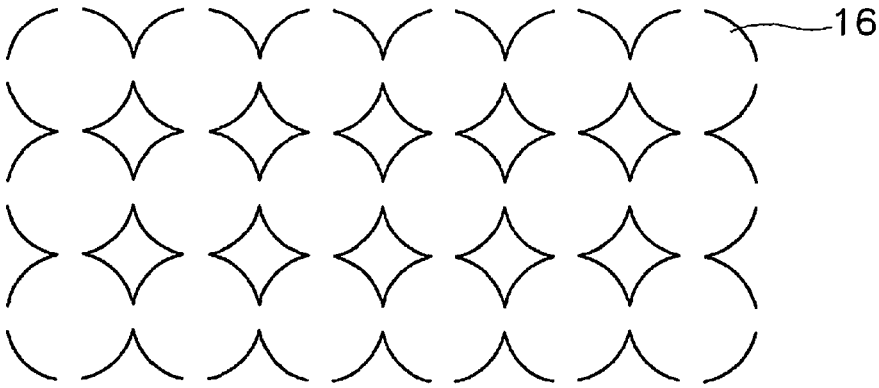
FIG. 1B is a cross-sectional view showing the inner structure thereof.
Figure 2A:
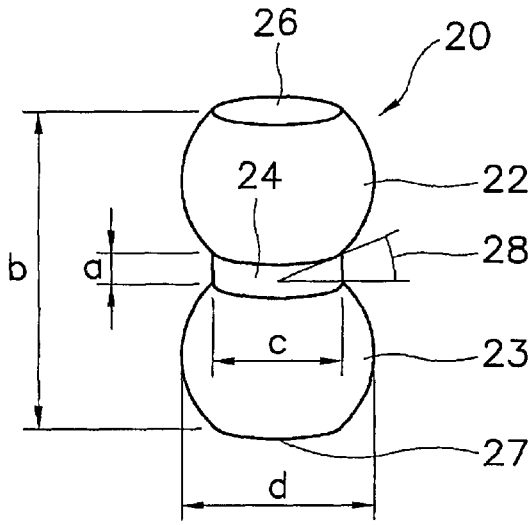
FIG. 2A is a perspective view of an elastic body according to the present invention.
Figure 2B:
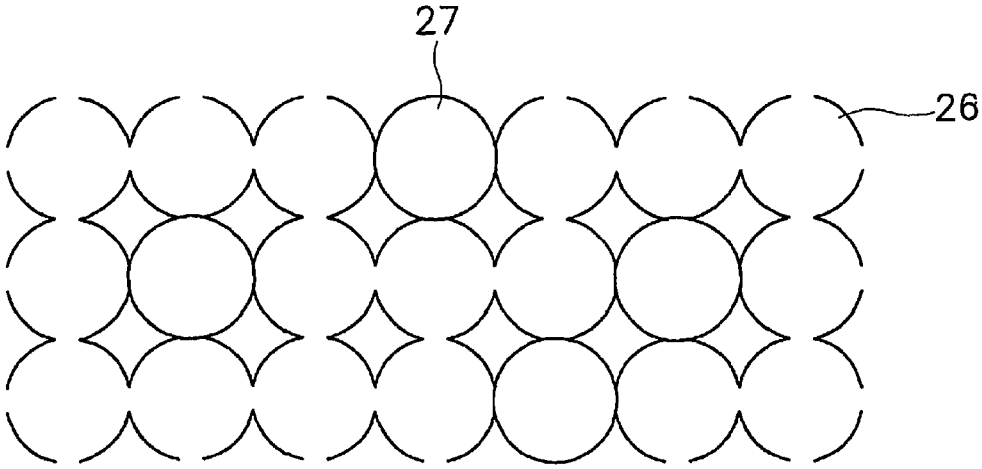
FIG. 2B is a cross-sectional view showing the inner structure thereof.

FIG. 2A is a perspective view of an elastic body according to the present invention, and FIG. 2B is a cross-sectional view showing the inner structure thereof.

Referring to FIG. 2A, an elastic body 20 has a substantially pillar-like shape, preferably a substantially cylindrical shape. The elastic body 20 has at least one concave portion 24 at the center thereof and at least two convex portions 22, 23 adjacent to the concave portion 24. The convex portion 22 has a spherical shape of which the upper portion 26 is truncated, and the convex portion 23 has a spherical shape of which the lower portion 27 is truncated.

The elastic body according to the present invention is made from a foamed body of a polyurethane polymer including polystyrene and comprises a plurality of foams in which air is contained. The elastic body has the concave portion at the center thereof to provide proper elasticity and repulsion. If the elastic body has a cylindrical structure without the concave portion, the elasticity of the elastic body itself will be remarkably reduced and a satisfactory function will not be obtained because the elastic bodies are arranged to make contact with adjacent elastic bodies and their side surfaces, and therefore there is no space for elasticity.

The user's satisfaction in terms of elasticity and stability can be met by properly adjusting a size of the concave portion and an angle obtained by the concave portion and the convex portion.

As a result of repeated experiments by the present inventor, it is found that a height a of the concave portion preferably ranges 3–50%, more particularly 10% or so, of a height b of the elastic body. When the height of the concave portion is so high that it exceeds 50%, the elasticity and stability of the elastic body is dramatically reduced and the duration of life is shortened. It is preferable that a diameter c of the concave portion ranges from 30 to 98%, more particularly 85–90%, of a diameter d of the convex portion. In the case that the diameter of the concave portion is less than 30% of the diameter of the convex portion, when a pressure is applied to the elastic body, the upper and lower portions thereof are twisted and the elastic body looses its stability.

In the case that the angle 28 obtained by the concave portion and the convex portion is so small, the elasticity becomes lowered. On the other hand, in the case that the angle 28 is so big, the stability becomes lowered and then working efficiency is lowered when a supporter is attached to the concave portion. Taking consideration of such factors, it is preferable to range the angle 28 between 5 and 60 degrees, more particularly 15 degrees.

FIG. 2B shows an enlarged cross-sectional view of the inner structure of the elastic body 20 comprising a plurality of air permeable foams 26 and a plurality of independent foams 27. Since the air permeable foams 26 have air permeability, air can pass through adjacent foams. However, air cannot pass through the independent foams 27 because they are independent from the adjacent foams and do not have such air permeability.

Unlike the prior elastic bodies, the elastic body 20 according to the present invention contains many independent foams 27 inside. The independent foams increase an impact absorption force by reducing a repulsive elasticity and are capable of keeping an effect that is provided by containing additives such as anti-bacterial agents and perfumes for a long period of time.

Since the air permeable foams 26 can freely absorb and discharge air, they discharge air upon pressure whereas they are restored by absorbing air upon removal of the pressure. Even if time passes, it is not necessary to refill the elastic body with air. Further, as the elasticity is changeable according to changes of external conditions in terms of the temperature and the climate, the elasticity does not become uneven by such changes.

However, as the elasticity is lowered when the independent foams 27 are too many, it is necessary to adjust a ratio of the independent foams 27 to the air permeable foams 26 to a proper degree. It is preferable to include 85–93% by volume of the air permeable foams 26 and 7–15%, particularly 10% or so, by volume of the independent foams 27. As each foam is illustrated in a spherical shape for the sake of convenience, its shape can vary in practice as long as it has a certain space formed therein. Although the openings of each air permeable foam are symmetrically positioned at the four sides thereof as shown in the cross-sectional view, such opening positions are not limited as long as the positions are properly located to have proper numbers.

A tensile strength of the elastic body is preferably 0.2–8 $kg/cm^2$. When a tensile strength is smaller than 0.2 $kg/cm^2$, there are problems that the elastic body gives a crumbling feel to the user and that it cannot sufficiently perform a cushioning function. When a tensile strength is greater than 8 $kg/cm^2$, the elastic body becomes very hard. Since the elasticity is not good when the percentage of elongation is less than 50%, the percentage of elongation is preferably more than 50%. It is particularly preferable that the percentage of elongation ranges between 200 and 300%.

Hereinafter, a manufacturing method of the elastic body according to the present invention will be explained in detail.

Above all, poly alcohol such as glycol, glycerin and sorbitol is mixed and stirred with polyether in a mixing ratio of 3–5 to 5–7 to prepare a polyether polyol compound. At this time, methyl alcohol is used as a solvent. A polyol mixture is obtained by mixing 30–50 parts by weight of the obtained polyether polyol compound, 2–20 parts by weight of polystyrene, and a trace amount of a catalyst and water. A preferred viscosity of the obtained polyol mixture is about 1100±300 cps at 40° C. Polystyrene is added to increase the elasticity of the elastic body. When the polyether polyol compound is utilized for a urethane foaming reaction without adding polystyrene, foams of about 30% by volume are obtained as independent foams. It can be understood that polystyrene opens the independent foams to change them into air permeable foams. Therefore, in order to obtain the appropriate number of the independent foams, the adding amount of polystyrene should be controlled.

Preferably, an amine compound, more particularly an amino acid monomer, is used as a catalyst and is added in an amount of about 0.3–3 parts by weight.

An appropriate amount of additives such as perfumes, anti-bacterial agents, insecticides and the like can be added and then stirred. Any perfumes which have the natural scent of roses, lilacs, orchids, or herbs, which are harmless to human bodies and which release a stress can be applied without exceptions. Solid perfumes are preferred to liquid perfumes as the smells of the former last longer than the smells of the latter. As for the anti-bacterial agents, it is preferred to use elvans capable of filtering bacilli and air, or synthetic anti-bacterial agents which are harmless to health. As for the insecticides, all insecticides can be used whether natural or synthetic. Various additives such as mold preventing agents, deodorants, and the like can be added.

An isocyanate compound is added to the obtained product to synthesize polyurethane and to implement a foaming reaction. Most compounds for implementing a polyurethane synthesis can be applied as the isocyanate compound. The preferred viscosity of the isocyanate compound is in a range of about 50±20 cps at 25° C. The polyurethane synthesis is implemented by mixing and stirring 40–80 parts by weight of the polyol mixture with 20–60 parts by weight of the isocyanate compound at about 20–80° C., preferably at about 40° C. Practically, the polyether polyol compound and the isocyanate compound are continuously added little by little in amount and are stirred. Concurrently. with this adding and stirring, the resulting product is injected into a mold to cast.

The stirring is implemented at the velocity of about 4000–5000 rpm for about 10 seconds. As soon as the stirring is implemented, the resulting product is immediately poured into a mold to carry out a foam casting. When the casting temperature is low, the foaming is not sufficiently good. When the casting temperature is high, the obtained body is rough. Therefore, the casting temperature is preferably 40±10° C., more particularly 40±2° C. The predetermined amount of the injected product is poured into the mold. In the course of transporting the mold by a conveyor, the mold is cooled at room temperature. After 5 to 10 minutes, the cast body is separated to obtain the elastic body according to the present invention.

The membrane portion of the obtained elastic body has a more compact structure than the inner portion thereof. The inner portion of the elastic body is obtained as an elastic body having a net-shaped structure in units of foams including independent foams and air permeable foams.

A method of manufacturing a mattress by using the elastic body according to the aforementioned method is as follows.

Figure 3:
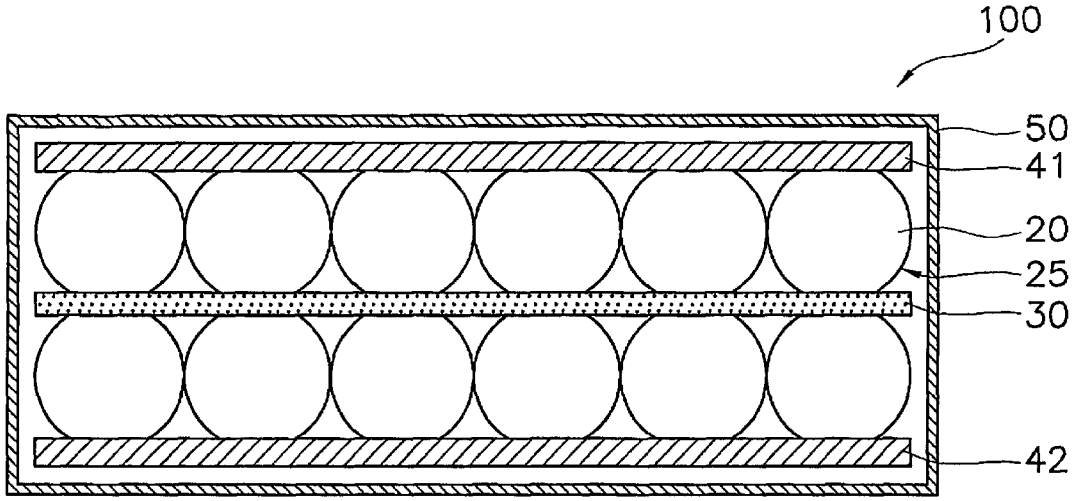
FIG. 3 is a schematic cross-sectional view of a mattress according to the present invention.

FIG. 3 illustrates a schematic cross-sectional view of a mattress according to the present invention.

A mattress 100 comprises an elastic body array 25, a supporter 30, flat plates 41, 42 provided at upper and lower portions of the elastic body array 25, and a wrapper 50 for wrapping the elastic body array 25, the supporter 30 and the flat plates 41 and 42. The elastic body array 25 is obtained by arranging one by one a plurality of elastic bodies 20 made from a foamed body of a polyurethane polymer including polystyrene and comprising a plurality of foams in which air is included. The supporter 30 is assembled at the concave portions of the elastic bodies 20 so as to support the elastic bodies 20.

When the mattress is manufactured, a plurality of the elastic bodies according to the present invention should be arranged. In order to prevent the elastic bodies from collapsing during such arrangement, the supporter 30 having holes which correspond to the concave portions at predetermined intervals is assembled in accordance with the concave portions. It is preferred to use a soft material for the supporter 30. If a hard board lacking flexibility is used for the supporter 30, an impact applied to a certain portion will be transferred to the whole mattress, so that a person on the mattress is disturbed. Preferably, a thermosetting resin such as an ethylene vinyl acetate (EVA) foam can be applied. When the EVA foam is applied, it is preferable to include a deodorant, as its smell is not good.

The flat plates 41, 42 are used for manufacturing a mattress having a uniform surface by supplementing empty areas resulted from the structure of the elastic bodies. A profile-processed sponge for cushioning can be used for tie flat plates 41, 42. This sponge is a soft sponge.

The wrapper 50 can be made of a material which is generally used for maintaining the mattress in shape and can include an inner wrapper and an outer wrapper. The outer wrapper is cloth of which the inside is quilted with artificial silk or cotton.

The mattress 100 can be applied-to various objects such as beds, sofas, chairs and cushions.

Hereinafter, the preferred embodiment of the present invention will be described in detail.

EXAMPLE 1

A polyether polyol compound was prepared by mixing poly alcohol and a polyether compound in a mixing ratio of 4 to 6 by weight. After 11.2 kg of the obtained polyether polyol compound and 3.3 kg of polystyrene were mixed and stirred at a room temperature, 80 g of an amino acid monomer and 25 g of water were added to and stirred with the obtained mixture for 30 minutes. A trace amount of a natural rose perfume and an elvan was added and stirred to mix the obtained mixture uniformly.

After 100 g of the obtained mixture was mixed with 30 g of methylene diisocyanate at 40° C. and was stirred at about 4000–5000 rpm for 8 seconds, this mixture was injected into a foaming mold of which the temperature was kept at 40° C. The mold was cooled to the room temperature when it was transported by a conveyor. After 8 minutes, the molded elastic body was separated from the mold to obtain an elastic body according to the present invention.

EXAMPLE 2

A supporter made from a thermosetting EVA sponge manufactured by adding a deodorant was holed at portions corresponding to 400 concave portions of the elastic bodies at an interval of the diameter of the elastic body. The 400 concave portions were inserted in the supporter to be arranged in a plate form. A profile-processed soft sponge for cushioning was provided at the upper and lower portions of the elastic body array. The obtained structure was wrapped by zippered wrapping cloth. A mattress for beds in queen size according to commercial classification was manufactured by wrapping the obtained structure with an outer wrapper of which the inside was quilted with artificial cotton one more time.

INDUSTRIAL APPLICABILITY

The elastic body according to the present invention has a good elasticity and a function of impact absorption as mentioned above and includes the independent foams inside which can contain the additives such as the anti-bacterial agents and the perfumes for a long period of time.

Accordingly, a mattress manufactured by employing such elastic bodies provides a soft and comfortable feel to its user and does not disturb a person next to the user because an impact applied to each elastic body is absorbed by the independent elastic body. In the event that the elastic bodies are applied to a bed mattress for domestic use, they have a good durability to the extent that their duration of life is more than 15 years.

While the present invention is described in detail referring to the attached embodiments, various modifications, alternate constructions and equivalents may be employed without departing from the true spirit and scope of the present invention.

What is claimed is:

1. An elastic body, made from a foamed polyurethane polymer including polystyrene, having a plurality of foams in which air is contained and at least one concave portion at the center thereof, said elastic body being prepared by a method comprising the steps of:

mixing a polyol compound and a polyether compound in a mixing ratio of 3–5 to 5–7 by weight;

adding 2–20 parts by weight of polystyrene and a trace amount of a catalyst to 30–50 parts by weight of the obtained mixture;

adding and stirring 20–60 parts by weight of an isocyanate compound and water at 20–80° C.; and molding the obtained reactant.

2. An elastic body as claimed in claim 1, wherein said foams include 85–93% by volume of a plurality of air permeable foams which are connected with adjacent foams and 7–15% by volume of a plurality of independent foams which are not connected with adjacent foams.

3. An elastic body as claimed in claim 1, wherein a height of said concave portion is 3–50% of a height of said elastic body.

4. An elastic body as claimed in claim 1, wherein a diameter of said concave portion is 30–98% of a diameter of a convex portion adjacent to said concave portion.

5. An elastic body as claimed in claim 1, wherein an angle between said concave portion and said convex portion adjacent to said concave portion is in a range of 5–60°.

6. A mattress comprising:

an elastic body array obtained by arranging side by side the elastic bodies of claim 1 within a predetermined area;

a supporter which is assembled at concave portions of said elastic bodies so as to support said elastic bodies;

two flat plates provided at upper and lower portions of said elastic body array; and a wrapping means for wrapping said elastic body array, said supporter and said flat plates.

7. A mattress as claimed in claim 6, wherein said supporter is made from a thermosetting resin.

8. A mattress as claimed in claim 6, wherein said mattress is used for a bed, a sofa, or a chair.

9. A method of manufacturing an elastic body, comprising the steps of:

obtaining polyether polyol by mixing poly alcohol and a polyether compound in a mixing ratio of 3–5 to 5–7 by weight;

producing a polyol mixture by adding 2–20 parts by weight of polystyrene, a trace amount of a catalyst and water to 30–50 parts by weight of the obtained polyether polyol; and mixing 40–80 parts by weight of the obtained polyol mixture and 20–60 parts by weight of an isocyanate compound at 20–80° C. and foam molding the obtained reactant.

10. A method as claimed in claim 9, further comprising the step of adding at least one additive selected from a group consisting of a perfume, an anti-bacterial agent and an insecticide after the step of producing said polyol mixture.

11. A method as claimed in claim 9, wherein said molding is carried out at a temperature of 40±10° C.

12. A method as claimed in claim 9, wherein a viscosity of said polyol mixture is in a range of 1100±300 cps at 40° C.

* * * * *